United States Patent [19]

Welsch et al.

[11] Patent Number: 4,991,725

[45] Date of Patent: Feb. 12, 1991

[54] COMPACT STORAGE SYSTEM

[75] Inventors: John H. Welsch, Moscow; John J. Chapko, Wilkes-Barre; Robert J. Cohn, Dallas, all of Pa.; Daniel C. Dubin, Brecksville, Ohio; Robert J. Carver, Nanticoke, Pa.

[73] Assignee: InterMetro Industries Corporation, Wilkes-Barre, Pa.

[21] Appl. No.: 770,798

[22] Filed: Aug. 29, 1985

[51] Int. Cl.[5] ..... A47F 5/00

[52] U.S. Cl. ..... 211/162; 312/201

[58] Field of Search ..... 211/162, 175; 16/35 R; 312/201, 250; 403/292; 104/121, 171, 172 R; 105/146, 147; 280/11.22, 79.14, 87.2; 301/5.3

[56] References Cited

U.S. PATENT DOCUMENTS

| | | | |
|---|---|---|---|
| 766,660 | 8/1904 | Bohannan | 312/201 |
| 1,530,211 | 3/1925 | Siemnash | 280/11.22 X |
| 1,807,075 | 5/1931 | Skar . | |
| 3,570,683 | 3/1971 | Dickgiesser et al. | 211/162 |
| 3,671,062 | 6/1972 | Ashworth | 403/292 |
| 4,061,379 | 12/1977 | Randall . | |
| 4,615,449 | 10/1986 | Naito et al. | 312/201 X |

FOREIGN PATENT DOCUMENTS

| | | | |
|---|---|---|---|
| 1144064 | 2/1963 | Fed. Rep. of Germany | 16/35 R |
| 2614159 | 10/1977 | Fed. Rep. of Germany . | |
| 2085284 | 4/1982 | United Kingdom . | |

*Primary Examiner*—Blair M. Johnson

*Attorney, Agent, or Firm*—Fitzpatrick, Cella, Harper & Scinto

[57] ABSTRACT

A compact storage system, mountable for operation on a flat base platform, includes at least one guide rail having a roof and two legs depending from the roof thereby defining an inverted, generally U-shaped continuous channel. The guide rail is mounted in spaced generally mutually parallel relation to the base platform with its legs projecting toward the base platform so that the channel opens downwardly. The compact storage system further includes at least one movable storage unit that is supported for translational movement on the base platform. One or more guide rollers are mounted on the storage unit to be received in the channel of the guide rail with the guide roller being formed to engage either one of the legs of the rail for movement relative thereto. Accordingly, translational movement of the storage unit is confined to a path defined by the guide rail.

2 Claims, 4 Drawing Sheets

59
3
56
32
18
56
59
31
34
50
50
50
86
93
86
17
15
80
28
80
28
20
17
15
3

COMPACT STORAGE SYSTEM

BACKGROUND OF THE INVENTION

1. Field of the Invention

The present invention relates to a high density or compact storage system that makes most efficient use of available floor space by providing storage units that are movable in such a way so as to define a single movable access aisle for all of the units. That is, any two movable storage units may be positioned to be directly adjacent each other at one side of each with access provided by an aisle on an opposite side of one of the units. If access is desired on the other side of that unit, initially directly adjacent the other unit, the first unit is merely moved to a position spaced from the other unit thereby moving the access aisle.

The present invention has particular utility as a compact storage unit that utilizes, as its basic components, a wire shelving system known as the SUPER ERECTA shelf system made and sold by InterMetro Industries, the assignee of the subject invention. However, the novel components of the subject invention may be used equally well in other storage systems in which the storage units are constructed in many different fashions.

Furthermore, the present invention provides particular advantages in application such as in the food service and hospital industries where sanitation is of prime concern.

2. Description of the Prior Art

Storage systems in which storage units are mounted for translational movement on a base, thereby providing a movable aisle offering access to each of the units and thereby making efficient use of floor space, are known. U.S. Pat. No. 3,801,176 (Higbee) relates to a typical storage system of this type, which is also known as an "active aisle" system. The storage system shown in the Higbee patent includes a pair of inverted, generally V-shaped rails that are mutually parallel and are securely mounted on a base platform such as a floor. A number of storage units or carts are mounted on wheels, each of which has a V-shaped groove formed in its circumference. Two wheels on each cart mate with, and are guided on, one of the two V-shaped rails. The wheels on each cart are fixed against swiveling movement, which is said to eliminate the need for directly attaching the guide rails to the floor.

The system shown in the Higbee patent has several notable disadvantages. More particularly, in applications in, for example, the food service and hospital industries, it is difficult to maintain sanitary conditions on and about the rails that are mounted on the floor since they readily collect undersirable foreign matter such as dirt and grease. The rails mounted on the floor also may constitute a safety hazard since operators and users of the system may strip or stumble over them. Additionally, users of the system may want to take independent wheeled utility carts into the active aisle to transport items to and from the storage units. However, guide rails mounted on the floor interfer with free movement of such utility carts into the active aisle.

Other known storage systems are operable on a flat base or floor on which a number of storage units are supported for translational movement. For example, U.S. Pat. No. 766,660 (Bohannan) relates to such a system in which each storage unit is provided with four wheels at its bottom that ride on the floor, while, at its top each unit is provided with a number of trolleys that override and are guided by two mutually guide rods. While the system of the Bohannan patent does not mount its guide rails on the base platform or floor, and thereby eliminates the disadvantages associated with guide rails of this type, it is nevertheless characterized by other disadvantages. More particularly, if there is any deviation in the flatness of the floor or deviation from a straight line by the guide rods, proper engagement of the trolleys on the guide rods properly to guide movement of the storage units not be maintained. Moreover, since the trolleys override the guide rods, it is necessary in assembling the system to either lift the storage units and associated trolleys up properly to position the trolleys on the guide rods or to mount the guide rods after the storage units are in position. Alternatively it is necessary to install the trolleys on the storage units after the storage units and guide raids are in position. However, a complicated arrangement for securing the trolleys to the storage units is required since the relative positions of the trolleys and guide rail may result in forces during storage unit movement that would tend to pull the trolley out of the storage unit. Moreover, as disclosed, the guide rods are secured to interior walls of the building or other structure in which the storage systems is mounted. Thus, the building itself must modified to accommodate the system as described.

Still other compact storage or high density systems are shown in U.S. Pat. Nos. 3,957,322 (Mastronardi et al.), which relates to a means for selectively shifting storage units; 4,432,589 (Sattel), which relates to devices for lighting the active aisle wherever it may be positioned; and 3,762,335 (Baker, Jr., et al.), which relates to a system in which storage units are mounted for movement on air cushions and are guided by rollers having a vertical axis and confined for movement in an upwardly open U-shaped channel secured to the floor or base platform.

Commercially available high density or compact storage systems are marketed by Amco Corporation, 901 North Kilpatrick Avenue, Chicago, Ill., Market Forge, Everett, Mass. 02149; Ames Color-File, 12 Park Street, Somerville, Mass. 02143; and, InterMetro Industries Corporation, North Washington Street, Wilkes-Barre, Penn. Each of these commercially available high density storage systems is generally of the type shown in the Higbee patent.

SUMMARY OF THE INVENTION

In its preferred embodiment, the compact storage system of the present invention eliminates the disadvatanges of the prior art which incorporate floor-mounted guide rails. Moreover, in its preferred embodiment, the present invention also eliminates disadvantages of prior art systems which, while providing guides at the top of each storage unit, are difficult to install and assemble.

The compact storage system of the present invention also incorporates a novel guide rail and mating guide roller configuration that facilitates ease of operation. Importantly, the system of the present invention may also be installed at any location having a generally flat floor without modification of the building or other surrounding structures. That is, this storage system may be complete self contained and need not be permanently attached to any surrounding structure, even though in some applications it may be desirable to do so.

In the preferred embodiment, the compact storage system of the present invention includes at least two end supports positioned in spaced relation on the floor or base platform. At least one guide rail is mounted to span the distance between these supports and is thereby mounted in generally parallel relation to the floor. The guide rail has a roof and two legs depending from the roof toward the base platform thereby to define a continuous U-shaped channel that is inverted or open downwardly. A number of movable storage units are mounted for translational movement between the supports. Each of the storage units is mounted for translational movement on the base platform or floor between the two supports and the total width of all of the movable storage units is less than the distance between the two supports. Guide rollers are mounted on each of the movable storage units and are received in the channel of the guide rail. These guide rollers are formed to engage either one of the legs of the guide rails for movement relative thereto. Accordingly, translational movement of each storage unit is confined by the guide rails and any two or the storage units can be moved to positions closely adjacent each other with a space for an access aisle remaining adjacent at least one of the two movable storage units.

Since the guide rail is mounted between the supports and spaced from the platform, no guide structure need be mounted on the platform. Accordingly, the system of the present invention may be assembled by positioning all storage units on the base platform, mounting the end supports at the outer extremes of the storage units, and then mounting the guide rail in position between the supports and over the guide rollers on each storage unit. Thus, the storage units need not be lifted to engage guide rollers and guide rails in order to complete the assembly; the guide rails need not be positioned under complimentary guide rollers after the storage units are in place; and the guide rollers need not be mounted on the storage units after the guide rails are in place. Moreover, the rails need not be secured in complicated fashion to an existing building structure.

The U-shaped channel of each guide rail is also quite deep compared to the height of the guide rollers. Therefore, interengagement of the rail and roller can be maintained even if the floor or base platform is not flat or the guide rail deviates from a straight line, for example by sagging.

It is thus readily apparent that significant advantages are achieved by the compact storage system of the present invention.

Other objects, aspects and advantages of the compact storage system in accordance with the present invention will be pointed out in or will be understood from the following detailed description of preferred embodiment thereof taken in conjunction with the accompanying drawing.

DETAILED DESCRIPTION OF THE PREFERRED EMBODIMENT

In its preferred embodiment, the compact storage system of the present invention is particularly well adapted for use in conjunction with a knock-down shelving system known as the SUPER ERECTA shelf system manufactured and sold by InterMetro Industries Corporation. However, the general principle of the subject invention may readily be incorporated in other systems using storage units of different constructions than the SUPER ERECTA shelf system. Nevertheless, for convenience, the present invention wil be described in conjunction with that system. (For a detailed description of the features of the SUPER ERECTA shelf system, attention is invited to U.S. Pat. Nos. 3,424,111 (Maslow) and 3,757,705 (Maslow), the disclosures of each of which are incorporate herein by a reference. Details of that system that do not form a part of the subject invention will not be described herein.)

Figure 1:
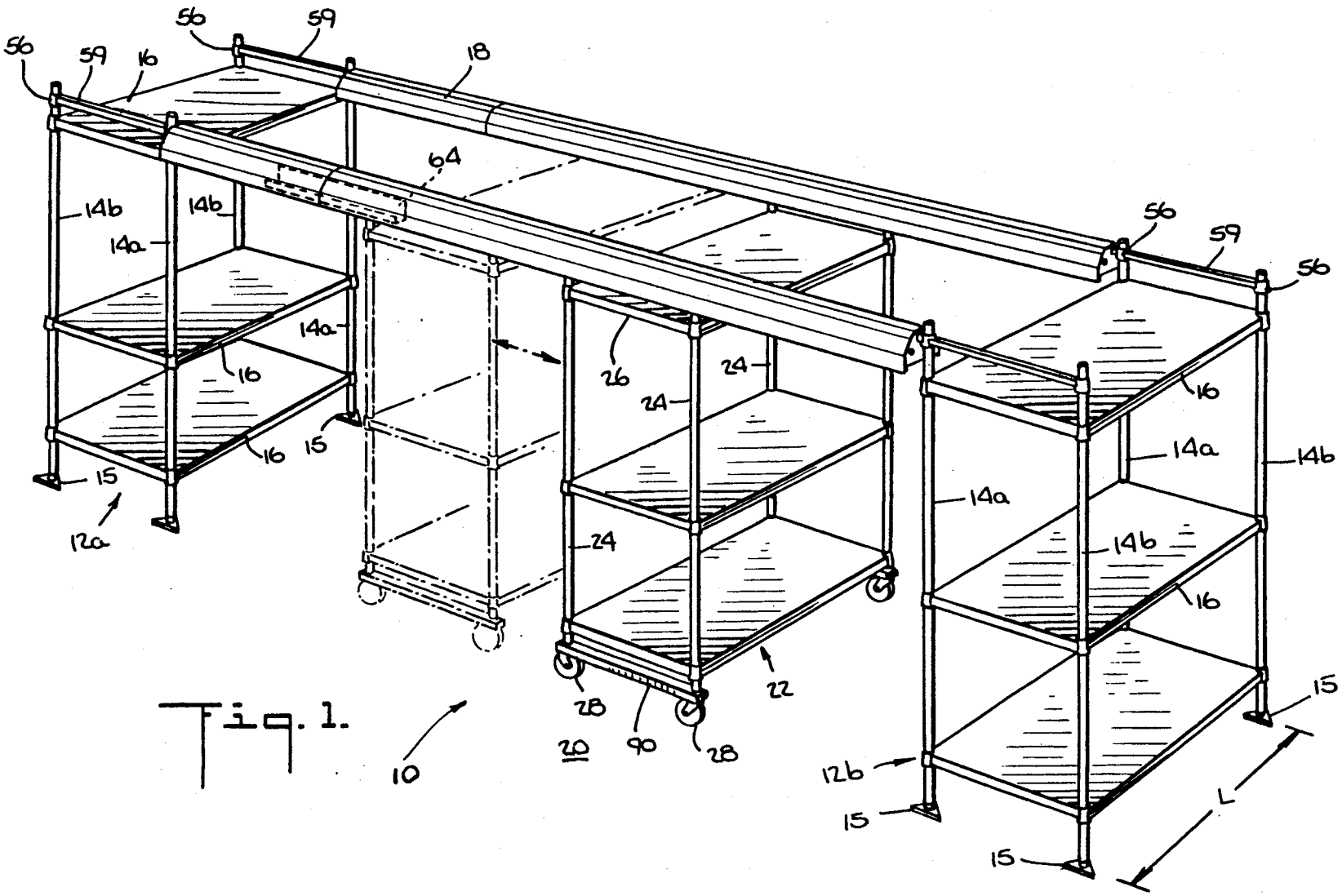
FIG. 1 is a perspective view of a compact storage system constructed and assembled in accordance with a preferred embodiment of the present invention.

Referring generally to FIG. 1, the compact storage system of the present invention, indicated at 10, includes two spaced stationary support structures 12, each respectively including four corner post 14 and a number of shelves 16 that are supported on the four corner posts 14. Each corner post 14 can be provided with a leveling foot assembly 15 comprising a threaded stem 17 mating with a thread plug (not shown) secured within the bottom end of each post 14. The support structures 12 are positioned so that the respective sides of each lie generally in the same plane.

A pair of guide rails 18, the detailed structure of each of which will be described in greater detail below, spans the distance between the innermost two corner posts **14*a* and 14*a* of the respective support structures 12*a* and 12*b*. These guide rails 18 are thereby spaced above a base platform or floor 20** on which the support structures stand.

At least one movable storage unit generally indicated at 22, which also may utilize components of the SUPER ERECTA shelf system, is mounted between the stationary support structures 12. In the preferred embodiment, therefore, this storage unit includes four corner posts 24 on which are mounted a number of shelves 26. A wheel 28 is mounted, with its axis extending generally perpendicularly to the plane defined by the sides of the support structures, at the bottom of each corner post 24 of the storage unit 22. Accordingly, the storage unit may be freely rolled for translational movement between the support structures.

As can be seen in FIG. 1, the storage unit and support structures utilize shelves having the same dimensions. Accordingly, the corner posts are spaced apart in the direction of the length of both the storage unit and support structures by the same distance L. Therefore, respective pairs of corner posts of the storage unit, on each side thereof, are aligned with one guide rail 18 extending between the support structures. Each of the corner posts of the storage unit is provided at its top with a guide rollers, to be described below in detail, that is received within one of the guide rails so that movement of the rollers and hence translational movement of the support structure is confined to a path defined by the guide rails.

From the general description above of the preferred embodiment of the present invention, it will readily be appreciated that no permanent structure need be installed on the base platform 20 in order to guide the storage unit 22 between the support structures 12. This beneficial effect results from mounting of the guide rails above the storage unit thereby eliminating permanently mounted guide rails on the base platform. Moreover, since the support structure on which the guide rails are mounted, are free-standing and also need not be permanently secured to the base platform or any other building structure, the compact storage system of the present invention eliminates the need for building modification and is completely portable. In addition, because the guide rails are mounted above, rather than below, the storage units, it is not necessary to lift the storage units onto floor mounted rails nor, as explained in greater detail below, is it necessary to lift the storage units or otherwise use complex assembly steps to suspend guide rollers from guide rails mounted above the storage unit. Also, as will be described in greater detail below, the design of the guide rails and rollers accommodate irregularities in the base platform and guide rail while reliably guiding the storage unit for movement.

While only one storage unit is shown in FIG. 1, it will be undestood that it is, in fact, desirable that several such units be positioned between the support structures. The total width of the storage units between the support structures should be less than the distance between the support structures. Thus any two storage units or any one storage unit and a support structure may be positioned closely adjacent each other with a space remaining between the one of those storage units and another thereof. This space is the so-called "active aisle", that can be shifted to provide access to any side of any storage unit while other storage units are moved to their closely adjacent space-saving positions.

The specific structural details of the guide rails extending between the support structures, of the guide rollers mounted on each storage unit, and of the structure for confining the wheels on which the storage units are mounted to a position with their axis of rotation extending generally perpendicularly to the plane defined between sides of the support structures will now be described.

Figure 2:
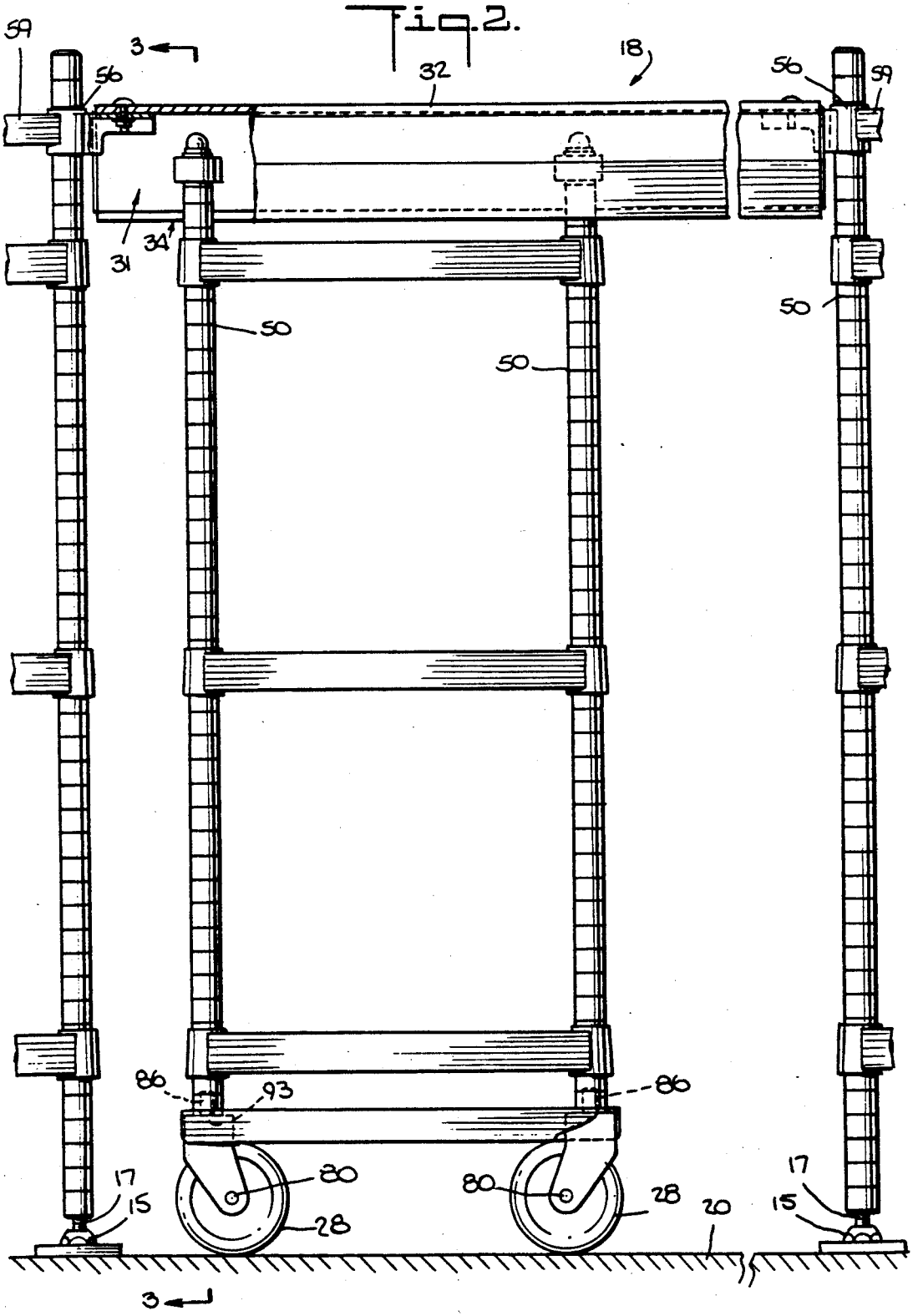
FIG. 2 is a side elevational view taken partly in vertical cross-section of the compact storage system shown in FIG. 1.
Figures 3, 4, 5:
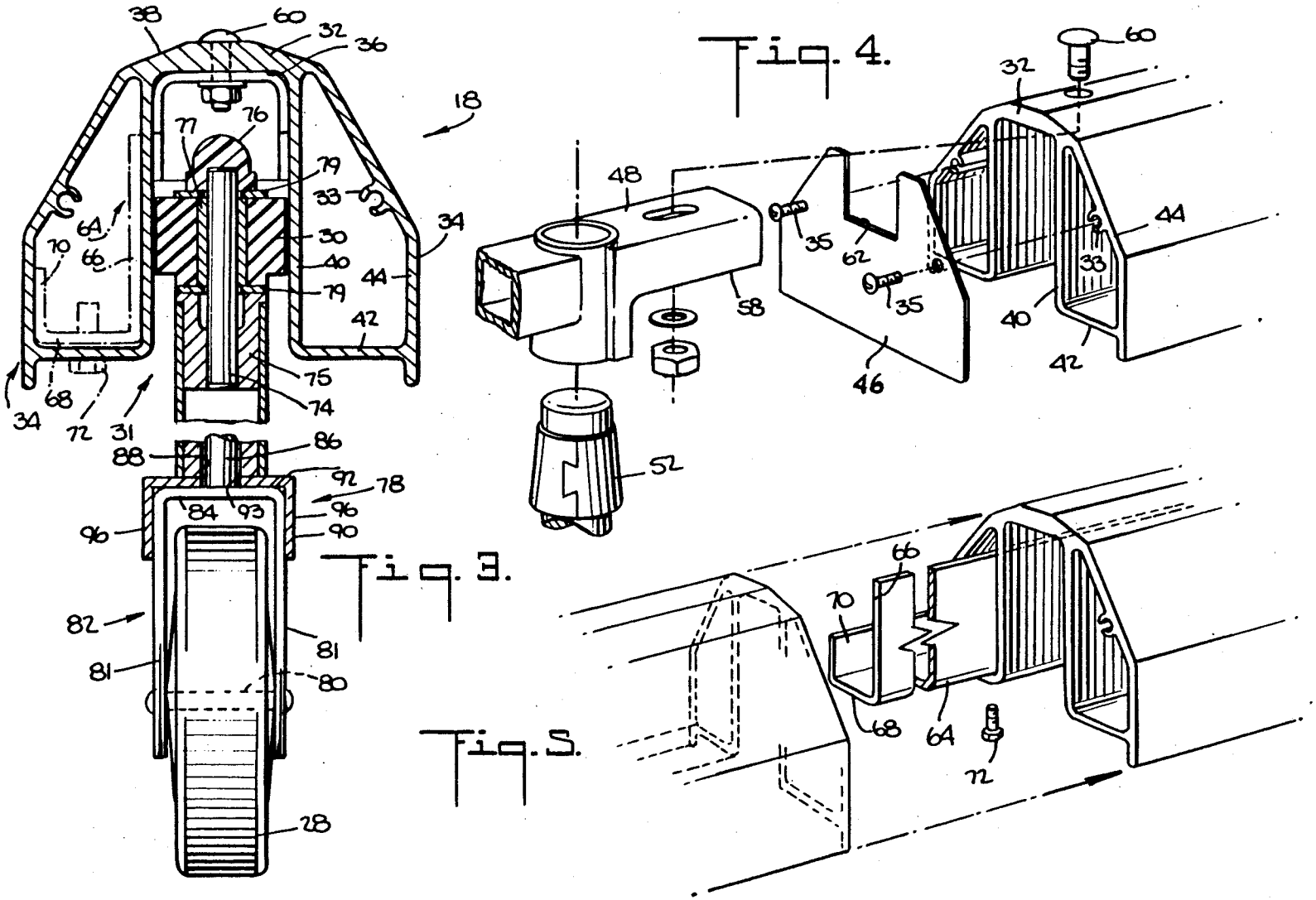
FIG. 3 is a vertical cross-sectional view taken on plane 3—3 in FIG. 2.
FIG. 4 is a perspective view of the end of a guide rail of the compact storage system of the present invention and of a coupling member for mounting it with stationary supports above the base platform.
FIG. 5 is an exploded perspective view of two guide rails and of a link element for joining them together.

As shown in cross-section in FIGS. 2 and 3, each guide rail 18 has a generally inverted U-shape that defines a continuous elongate, downwardly open channel 31. The U-shaped cross-section of the guide rail is defined by a roof 32 and two depending legs each generally indicated at 34, and has substantial height or depth compared to its width.

The roof 32 of the channel has a generally flat inner wall 36 and an inverted V-shaped outer wall 38. Each leg 34 comprises by a box beam that includes an inwardly facing vertical wall 40, a bottom wall 42 and an outer wall 44 at least part of which is upwardly inwardly sloped. In the preferred embodiment, each guide rail 18 may be extruded of, for example, aluminum with the box beam leg structure of the extrusion providing great resistance of bending thereof when mounted between the support structures.

The external configuration of the guide rail is particularly well suited for applications of the compact storage system such as those that require sanitary conditions. More particularly, the external shape of the guide rail tends to shed foreign material, since there are no external crevices or other irregularities in the outer surface which would tend to trap and collect foreign contaminants.

As shown in FIG. 4, the end of each guide rail 18 may be provided with an end cap 46 to enclosed the open box beam legs 34 and prevent infiltration of foreign matter thereinto. These end caps have the same peripheral configuration as the cross section of the guide rail. As can be seen the guide rails are extruded with a small cylindrical channel 33 in the inner surface of the side walls 44 of the legs 34. The end caps can be secured to the rail by screws 35 threaded into these channels.

The guide rails may also be equipped with coupling members 48 specifically designed to cooperate with corner posts of the InterMetro Industries SUPER ERECTA shelf system. More particularly, as described in U.S. Pat. Nos. 3,424,111(Maslow) and 3,757,705(Maslow), each corner post is generally cylindrical and has regualrly spaced annual grooves 50 in its outer surface. Each corner post cooperates with one or more collars 52 having a cylindrical inner surface and a frusto-conical outer surface. Each collar is adapted to mate with a sleeve 54 mounted at the corners of each shelf and having a complimentary frusto-conical inner surface. As explained in the Maslow Patents, the inner surface of the collar also is formed with an annular rib that interfits with any one of the annular grooves 50 in the corner post. Accordingly, when a shelf having the frusto-conical sleeves at its corners is mounted with the sleeves telescopically received about the collars mounted on the corner parts, load on the shelf tends to cause the collars to collapse radially inwardly toward the respective corner posts thereby securely mounting the collar, and hence the sleeve, to the post and thereby to support the shelf. Each coupling member 48 for the guide rails makes use of this corner post, collar, and sleeve configuration. More particularly, as shown in FIG. 4 each coupling member 48 is formed with a sleeve 56 having a frusto-conical inner surface that mates with one collar 52 carried on a corner post. An inverted U-shaped arm 58 projects radially away from the sleeve and engages the inner wall 36 of the roof 32 of the guide rail and the inner walls 40 of the legs 34 of the rail as can best be seen in FIG. 3. At least one bolt 60 passes through the roof of the guide rail and the arm 58 to secure the two tightly together. As shown in FIGS. 1,2 and 4, the coupling member 48 may also include a beam 59 extending from the sleeve 56 in a direction opposite the arm 58 to another corner post of a stationary storage unit 12. A similar sleeve 56 is mounted at the end of the beam 59 and is engaged with a collar on the other post in the same manner as described above. Accordingly, with the coupling member 48 mounted with the guide rail, and with the sleeves 56 of the coupling member received about collars mounted on the corner posts of the stationary storage unit, the weight of the guide rail similarly tends to cause the collars to collapse radially about the corner posts to securely mount the two together and thereby support the guide rail.

It will also be appreciated that the end cap 46 for each guide rail is to be provided with a notch 62 that accommodates the arm 58 of the coupling member 48.

In some applications, it may be desireable to have large numbers of storage units mounted between two stationery support structures 12. It the guide rails are made in standard lengths, it may, therefore, be desirable to assemble two or more guide rails to provide greater than standard lengths for accommodating such large numbers of storage units. Accordingly, in the preferred embodiment of the present invention, link members 64 may also be provided to join two or more guide rails as shown in FIGS. 1,3 and 5. These link members have a generally J-shaped cross section comprising a first major leg 66 formed to lie tightly against the inner surface of the inner wall 40 of a leg of the guide rail, a horizontal leg 68 formed to lie tightly against the inner surface of the bottom wall 42 of a leg of the guide rail, and a minor leg 70 formed to lie closely against the inner surface of the outer wall 34 a leg of the guide rail. These link members are secured to adjacent guide rails mounted together thereby by suitable bolts 72 passing through the bottom wall 42 and into a threaded insert 73 secured in the horizontal leg 68. It has been found that with guide rails made in eight (8) foot lengths, link members of two (2) foot lengths provide sufficient rigidity at the junction of two guide rails.

The guide rollers mounted at the top of each corner post of each storage unit will now be described in detail. These guide rollers are preferably made of an antifriction material such as that sold under the trademark DELRIN. As shown in FIG. 5, each such guide roller 30 is mounted on a stub shaft 74 threaded into an end cap 75 secured within the upper portion of a corner post 24, for example, by a press fit. The axis of this stub shaft extends with the axis of the corner post. An antifriction bushing 77 may be provided between the roller 30 and the stub shaft 74 and an antifriction washer 79 can be mounted on either end of the roller all to permit the roller to freely rotate. Accordingly, the guide roller is adapted to rotate about the axis of the stub shaft and therefore its circumference can contact the inner surface of either inner wall 40 of the legs of the guide rail. The diameter of each guide roller is slightly smaller than the distance between opposing inner walls 40 of the guide rail. Accordingly, movement of each storage unit is confined by engagement of the guide rollers with the guide rails to a path defined by the guide rails.

As can further be seen in FIG. 3, a cap nut 76 is mounted on the top of each stub shaft to retain the roller 30 thereof. This cap nut is either made of or coated with an antifriction material such as nylon. Accordingly, if there is any irregularity in the base platform or deflection of the guide rail which would cause the top of the cap nut to engage the inner wall 36 of the roof of the guide rail, the cap nut would nevertheless freely slide along that inner wall.

Figure 6:
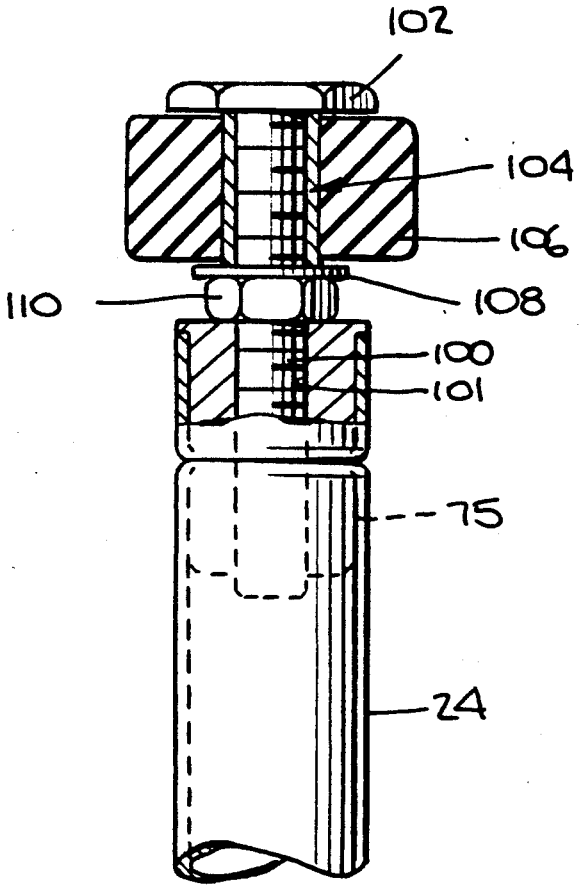
FIG. 6 is a vertical cross-sectional view of an alternative guide roller construction.

An alternative guide roller construction is shown in FIG. 6 and includes an end cap 75 having a thread bore 101 that again is secured in the top of each corner post 24 of each movable storage unit 22, for example, by being crimped therin. A threaded bolt 100 having a thin broad hexagonaly head 102 is provided with a bushing 104, and a guide roller 106, also preferrably made of DELRIN material, is mounted about the bushing. As can be seen, the busing has a slightly larger axial dimension than does the roller. The bushing is clamped between the head 102 of the bolt 100 and a flat washer 108 by a clamp nut 110 threaded onto the bolt 100. Therefore, the roller 106 can freely rotate on the bushing between the head 102 and the washer. The bolt 100 is mounted on the corner post by being threaded into the bore 101 of the end cap 75.

The guide roller assembly including the bolt 100, bushing 104, washer 108, clamp nut 110, and guide roller 106 may be shipped to an end user in assembled form, while the corner posts 24 for the storage units are shipped with the end caps 75 secured in place. Thus the end user can assemble the storage units from the bottom up with the shelves 26 mounted with the corner posts. After the storage unit assemblies are otherwise complete, the guide roller assemblies may be mounted on top of each corner post as described above and the system assembly can thereafter be completed.

The details of the wheels that support each storage unit for translational movement will now be described. As can be seen in FIG. 3, each wheel may comprise a caster assembly, gnerally indicated at 78, including the wheel 28, which is mounted on a horizontally extending shaft 80 spanning the distance between two legs 81 of a horn 82. The base 84 of the horn is provided with an upwardly projecting pin 86 that is received in a socket 88 fixed in the bottom of each corner post 24 of each storage unit 22. As is evident in FIG. 2, the axis of the pin 86 is offset with respect to the axis of the shaft 80, that is, the axes of the pin and shaft are skewed. Accordingly, each wheel is located so that its circumference lies substantially within the lateral extreme of each storage unit. Therefore, adjacent storage units may be rolled to positions abutting one another without their respective wheels interfering.

The present invention also includes a structure for preventing the caster assembly 78 from swiveling in its socket 58 with respect to the corner posts 24. This structure confines the wheels such that the shaft of each extends generally perpendicularly to the plane defined by the sides of the storage unit and support structures.

More specifically, as can be seen in FIGS. 1, 2, and 3 this structure comprises an inverted generally U-shaped channel 90 having length approximately equal to the width of a storage unit. The base 92 of the channel is formed with two holes 93 near its extremes each of which is concentric respectively with one pin of each caster when mounted in respective corner posts 24 of the storage unit. The sides 96 of the channel are spaced by a distance slightly greater than the width of the horn 82, namely the distance between the outer surfaces of the legs of the horn. Accordingly, the caster assemblies and channel are assembled so that the sides of the channel embrace the legs of the horn when the two are attached to the storage unit with the pins 86 of the caster assemblies received through the holes 93 and secured in the sockets 86. The channel prevents swiveling movement of each yoke and therefore the entire caster assembly.

Accordingly, it will be appreciated that the compact storage system of the present invention provides many advantages. As prointed out above, this system generally is advantageous since it does not incorporate any structure that is required to be secured to a building in which it is assembled. The formation of the guide rails as inverted U-shaped channels mounted at the top of the system facilitates assembly of the various components. More particularly, the support structures may be assembled, the storage units may thereafter be assembled, and the guide rails may then be mounted between the support structures, being place into an engagement with the guide rollers of the storage units. Thus, each individual component of the system may be assembled from the floor up.

The particular structure of the guide rail is particularly advantageous for use in applications requiring sanitary conditions. Each of the components of the invention may be readily manufactured with mass production techniques as a modular system for specific assembly to suit specific needs.

Accordingly, although a particular embodiment of the subject invention has been described above in detail, it is to be understood that this is for purposes of illustration. Modifications can be made to the described structure in order to adapt it to other particular applications.

What is claimed is:

1. A compact storage system mountable for operation on a planar base platform, said storage system comprising:

at least one guide rail means having a roof and two legs projecting from said roof thereby defining a generally U-shaped continuous channel;

means for mounting said guide rail means in spaced, generally mutually parallel relation to said base platform with said legs projecting toward said base platform so that said channel opens theretoward;

at least one movable storage unit;

means for supporting said storage unit for translational movement on said base platform, said supporting means comprising two casters each including a wheel, and a horn having a base and depending legs between which said wheel is mounted for rotation, and further comprising retainer means fixed to said movable storage unit and embracing said legs of said horn, said retainer means including a channel member simultanieously embracing the horns of said two casters;

guide roller means mounted on said storage unit and received in said channel of said guide rail means, said guide roller means being formed to engage either one of said legs of said guide rail means for movement relative thereto, whereby translational movement of said movable storage unit is confined to a path defined by said guide rail means.

2. A compact storage system mountable for operation on a planar base platform, said system comprising:

at least two support means positioned in spaced relation on said base platform;

at least one guide rail means mounted to span the distance between said support means in generally parallel relation to said base platform, said guide rail means having a roof and two legs depending from said roof toward said base platform thereby defining a continuous U-shaped channel;

a plurality of movable storage units;

means for supporting each of said storage units for translational movement on said base platform between said two support means, the total dimension of said plurality of movable storage units between said two support means being less than the distance between said two support means; each said supporting means comprising two casters each including a wheel and a horn having a base, and further comprising depending legs between which said wheel is mounted for rotation, and retainer means fixed to said movable storage unit and embracing said legs of said horn, said retainer means including a channel member simultaniously embracing the horns of said two casters; and guide roller means mounted on each of said movable storage units and received in said channel of said guide rail means, said guide roller means being formed to engage either one of said legs of said guide rail means for meovement relative theretoward;

whereby translational movement of each said movable storage unit is confined to a path defined by said guide rail means, and wherein any two of said movable storage units can be moved to positions closely adjacent each other with a space remaining adjacent at least one of said two adjacent moveable storage units.

* * * * *

UNITED STATES PATENT AND TRADEMARK OFFICE

CERTIFICATE OF CORRECTION

PATENT NO. : 4,991,725

DATED : February 12, 1991

INVENTOR(S) : JOHN H. WELSCH, ET AL.

It is certified that error appears in the above-identified patent and that said Letters Patent is hereby corrected as shown below:

ON THE TITLE PAGE, AT ITEM [57] ABSTRACT

Line 5, "spaced" should read --spaced,--.

COLUMN 1

Line 60, "interfer" should read --interfere--.
Line 68, "top each" should read --top, each--.

COLUMN 2

Line 1, "mutually" should read --mutually parallel--.
Line 17, "guide raids" should read --guide rods--.
Line 25, "systems" should read --system--.
Line 26, "must modified" should read --must be modified--.
Line 52, "vatanges" should read --vantages--.
Line 66, "complete" should read --completely--.

COLUMN 3

Line 37, "complimentary" should read --complementary--.

COLUMN 4

Line 24, "incorporate" should read --incorporated--.
Line 30, "corner post 14" should read --corner posts 14--.
Line 66, "guide rollers," should read --guide roller,--.

UNITED STATES PATENT AND TRADEMARK OFFICE

CERTIFICATE OF CORRECTION

PATENT NO. : 4,991,725

DATED : February 12, 1991

INVENTOR(S) : JOHN H. WELSCH, ET AL.

It is certified that error appears in the above-identified patent and that said Letters Patent is hereby corrected as shown below:

COLUMN 5

Line 11, "structure" should read --structures--.
Line 28, "undestood" should read --understood--.

COLUMN 6

Line 6, "enclosed" should read --enclose--.
Line 20, "annual" should read --annular--.
Line 25, "complimentary" should read --complementary--.
Line 32, "parts," should read --posts,--.
Line 64, "desireable" should read --desirable--.

COLUMN 7

Line 12, "wall 34 a" should read --wall 34 of a--.
Line 54, "therin." should read --therein.--.
Line 55, "hexagonaly" should read --hexagon--.
Line 56, "preferrably" should read --preferably--.
Line 58, "busing" should read --bushing--.

COLUMN 8

Line 12, "gnerally" should read --generally--.
Line 52, "prointed" should read --pointed--.
Line 61, "place" should read --placed--.

COLUMN 9

Line 29, "simultanieously" should read --simultaneously--.

UNITED STATES PATENT AND TRADEMARK OFFICE

CERTIFICATE OF CORRECTION

PATENT NO. : 4,991,725

DATED : February 12, 1991

INVENTOR(S) : JOHN H. WELSCH, ET AL.

It is certified that error appears in the above-identified patent and that said Letters Patent is hereby corrected as shown below:

COLUMN 10

Line 24, "simultaniously" should read --simultaneously--.
Line 30, "meovement" should read --movement--.
Line 37, "moveable" should read --movable--.

Signed and Sealed this

Third Day of March, 1992

*Attest:*

HARRY F. MANBECK, JR.

*Attesting Officer*

*Commissioner of Patents and Trademarks*